US010460899B2

(12) United States Patent
Behling et al.

(10) Patent No.: US 10,460,899 B2
(45) Date of Patent: Oct. 29, 2019

(54) MODIFICATION ARRANGEMENT FOR AN X-RAY GENERATING DEVICE

(71) Applicant: KONINKLIJKE PHILIPS N.V., Eindhoven (NL)

(72) Inventors: Rolf Karl Otto Behling, Norderstedt (DE); Ewald Roessl, Ellerau (DE)

(73) Assignee: KONINKLIJKE PHILIPS N.V., Eindhoven (NL)

( * ) Notice: Subject to any disclaimer, the term of this patent is extended or adjusted under 35 U.S.C. 154(b) by 260 days.

(21) Appl. No.: 15/516,936

(22) PCT Filed: Sep. 30, 2015

(86) PCT No.: PCT/EP2015/072500
§ 371 (c)(1),
(2) Date: Apr. 5, 2017

(87) PCT Pub. No.: WO2016/055319
PCT Pub. Date: Apr. 14, 2016

(65) Prior Publication Data

US 2017/0301503 A1 Oct. 19, 2017

(30) Foreign Application Priority Data

Oct. 6, 2014 (EP) ..... 14187712

(51) Int. Cl.
*H01J 35/14* (2006.01)
*H01J 35/10* (2006.01)
(Continued)

(52) U.S. Cl.
CPC ..... *H01J 35/10* (2013.01); *H01J 35/06* (2013.01); *H01J 35/14* (2013.01); *H01J 35/24* (2013.01); *H01J 2235/086* (2013.01)

(58) Field of Classification Search
CPC .. H01J 35/10; H01J 35/06; H01J 35/14; H01J 35/02; H01J 35/24; H01J 2235/086; A61B 6/4021
(Continued)

(56) References Cited

U.S. PATENT DOCUMENTS 5,313,510 A 5/1994 Ebersberger et al.
5,581,591 A 12/1996 Burke et al.
(Continued)

FOREIGN PATENT DOCUMENTS

JP 5041191 A 2/1993
JP 9120787 A 10/1995
(Continued)

*Primary Examiner* — Jurie Yun
(74) *Attorney, Agent, or Firm* — Larry Liberchuk

(57) ABSTRACT

The invention relates to a modification arrangement for an X-ray generating device, a modification method, a computer program element for controlling such device and a computer readable medium having stored such computer program element. The modification arrangement comprises a cathode, an anode (2) and modification means, e.g. a modification device. The cathode is configured to provide an electron beam (15). The anode (2) is configured to rotate under impact of the electron beam (15) and is segmented by slits (21) arranged around the anode's circumference. The modification means are configured to modify the electron beam (15) when the electron beam (15) is hitting one of the anode's rotating slits (21).

11 Claims, 3 Drawing Sheets

(51) Int. Cl.
*H01J 35/24* (2006.01)
*H01J 35/06* (2006.01)

(58) Field of Classification Search
USPC ..... 378/125, 137, 144
See application file for complete search history.

(56) References Cited

U.S. PATENT DOCUMENTS

| | | | |
|---|---|---|---|
| 6,181,771 | B1 | 1/2001 | Hell |
| 6,980,628 | B2 | 12/2005 | Wang et al. |
| 7,315,024 | B2 | 1/2008 | Ose et al. |
| 7,945,024 | B2 | 5/2011 | Lemaitre |
| 8,189,742 | B2 | 5/2012 | Behling |
| 8,611,490 | B2 | 12/2013 | Zhang |
| 8,687,769 | B2 | 4/2014 | Behling |
| 2010/0046712 | A1 | 2/2010 | Behling |
| 2011/0235784 | A1 | 9/2011 | Behling |
| 2014/0126698 | A1 | 5/2014 | Behling |

FOREIGN PATENT DOCUMENTS

| | | | |
|---|---|---|---|
| JP | 2011-233365 | A | 11/2011 |
| JP | 2011233365 | A | 11/2011 |
| WO | 2008044194 | A2 | 4/2008 |
| WO | 2011051861 | A2 | 5/2011 |
| WO | 2013001384 | A1 | 1/2013 |
| WO | 2013076598 | A1 | 5/2013 |
| WO | 2013175370 | A1 | 11/2013 |

MODIFICATION ARRANGEMENT FOR AN X-RAY GENERATING DEVICE

CROSS-REFERENCE TO PRIOR APPLICATIONS

This application is the U.S. National Phase application under 35 U.S.C. § 371 of International Application No. PCT/EP2015/072500, filed on Sep. 30, 2015, which claims the benefit of European Patent Application No. 14187712.6, filed on Oct. 6, 2014. These applications are hereby incorporated by reference herein.

FIELD OF THE INVENTION

The invention relates to a modification arrangement for an X-ray generating device, a system for X-ray imaging, a modification method, a computer program element for controlling such device and a computer readable medium having stored such computer program element.

BACKGROUND OF THE INVENTION

U.S. Pat. No. 8,687,769 B2 describes a rotatable anode for an X-ray tube, wherein the anode comprises a first unit adapted for being hit by a first electron beam and at least a second unit adapted for being hit by at least a second electron beam. Further, an X-ray system is described, which comprises an anode and a main cathode for generating an electron beam. The main cathode is adapted to generate a first electrical potential. The X-ray system further comprises an auxiliary cathode for influencing a second electrical potential.

WO 2013/076598 A1 describes an X-ray tube for faster, periodic modulation of a generated X-ray beam. The X-ray tube comprises an anode disk which comprises a circumferential target area with a target surface area, a focal track centre line, and a beam-dump surface area. The target surface area is provided such that, when being hit by an electron beam, X-rays for X-ray imaging can be generated; and the beam-dump surface area is provided such that, when being hit by an electron beam, no useful X-rays for X-ray imaging can be generated.

WO 2013/001384 A1 describes the generation of multiple energy X-ray radiation. In order to provide multiple energy X-ray radiation with increased switching frequencies, a rotating anode for an X-ray tube is provided with an anode body, a circular focal track, and an axis of rotation. The focal track is provided on the anode body and comprises at least one first focal track portion and at least one second focal track portion. Transition portions are provided between the at least one first and second focal track portions.

X-ray tubes may be equipped with segmented anodes. In a segmented anode, slits or slots are present radially inwards into the outer circumference of the anode to reduce thermal stress which arises from large temperature gradients during operation of the X-ray tube.

Upon anode rotation, an electron beam provided by a cathode repeatedly hits the slits. The anode outputs a photon flux when the electron beam hits the anode. If a focal spot width of the electron beam is small with respect to a width of a slit, the photon flux drops during passage, as X-rays are generated deep inside the slot and will neither enter the used electron beam nor reach an object in e.g. a CT scanner.

The photon flux drop or drop of intensity may pose an issue for the detection and reconstruction of an image, in particular when the X-ray detector reacts strongly nonlinear. In other words, when a photon flux drops, the signal may rise sharply to a signal burst.

During passage of slits through the focal spot of the electron beam, these signal bursts appear to be random and add a noise, which can be significant and undesired.

As a result, it would be desired to keep the photon flux stable despite of the existence of the slits to increase the quality of image detection.

SUMMARY OF THE INVENTION

Hence, there may be a need to provide a modification arrangement for an X-ray generating device which allows an improved image quality.

The problem of the present invention is solved by the subject-matters of the independent claims, wherein further embodiments are incorporated in the dependent claims. It should be noted that the aspects of the invention described in the following apply also to the X-ray generating device, the system for X-ray imaging, the modification method, the computer program element, and the computer readable medium.

According to the present invention, a modification arrangement for an X-ray generating device is presented. The modification arrangement comprises a cathode, an anode and modification means, e.g. a modification device.

The cathode is configured to provide an electron beam. The anode, having a focal track, is configured to rotate under impact of the electron beam and is segmented by slits, e.g. being present radially inwards into the outer circumference of the anode traversing the focal track and substantially equidistantly arranged around the anode's circumference. The slits are present from the side of the anode where the focal track is present through the opposite side at the bottom. At the inner position where the slit ends, at a radial position closer to the rotation axis of the anode than the anode's circumference, a circular hole is present in order to prevent cracking of the anode at the inner position where the slit ends. The radial length of the slits is typically about 20-50% of the radius of the anode. The circular hole diameter is typically about 0.5 to 5% of the diameter of the anode. There are typically about 10 to 30 slits substantially equidistantly and radially arranged around the anode's circumference. The modification means, e.g. a modification device, are configured to modify the electron beam when the electron beam is hitting one of the anode's rotating slits.

Thereby, a stabilizing of the photon flux from the segmented rotating anode is achieved. In other words, the dip of the photon flux during passage of a slit in the anode is reduced. No or nearly no signal bursts appear and the corresponding undesired noise is also completely or nearly avoided. As a result, the detection and/or reconstruction of an image is improved and thereby the quality of image data is increased.

In an example, the modification device is also configured to modify the electron beam when one of the slits is approaching and/or departing the electron beam. This means, as soon as one of the slots which rotate with the anode approaches and/or departs the position where the electron beam hits the anode and where the X-radiation is generated, the electron beam is modified. E.g. the dimension of the focal spot in tangential direction may be widened from 0.6 mm to 1.0 mm or 2.0 mm. If a slit has a width of e.g. 0.3 mm the intensity drop would diminish approximately from 50% to 33% or even 16%. The modification could be opposite. The beam width in tangential direction could also be shortened to 0.3 mm or less, which would diminish the period of reduced intensity to about 3 times the width of the slit divided by the focal track speed or less.

The modification of the electron beam can be understood as a modification of a focal spot of the electron beam at a position, where the electron beam impinges on the anode. The modification of the electron beam can be achieved according to one of the following aspects.

In an example, the modification is a deflection of the electron beam.

In an example, the deflection is a tangential deflection relative to the rotational movement of the anode. In an example, the modification device is configured to deflect the electron beam tangentially forward in the direction of the anode's rotational movement and then backward against the direction of the anode's rotational movement to reduce the time during which the electron beam hits one of the slits. This means that stabilizing the photon flux from the segmented rotating anode proposes that the electron beam is e.g. deflected tangentially back and forth as soon as one of the slits which rotate with the anode approaches the position where the electron beam hits the anode and where the X-ray is generated. In other words, the electron beam passes the slit in a fast pace so the period of time is minimized during which the photon flux is reduced.

In an example, the modification device is in contrast configured to deflect the electron beam tangentially backward against the direction of the anode's rotational movement and then forward in the direction of the anode's rotational movement to reduce the time during which the electron beam hits one of the slits.

In an example, the modification is a widening of the electron beam in a radial and/or a tangential direction. The widening of the electron beam leads to an enlargement of the focal spot during deflection. In other words, the focal spot will appear widened. If the deflection is fast enough and not too wide (ca. 1 focal spot width), the time of distortion will be small with respect to the integration period used to generate e.g. a CT projection. The relative distortion of the projection will then be acceptable. The widening can be combined with the deflection of the electron beam.

In an example, the modification is a shortening of the electron beam in a radial and/or a tangential direction. The shortening can be combined with the deflection of the electron beam.

In an example, the modification is a change of shape of a cross section of the electron beam in the plane of the slits. The change of shape of a cross section of the electron beam can be a radial rotation from a rectangular shape to e.g. a diagonal trapezoid shape. In comparison to the rectangular shape, the diagonal trapezoid shape will not disappear completely in a slit, but rather be "jammed" in the slit, so that at least parts of the electron beam do not disappear in the slit. The change of shape can also be combined with the deflection, widening and/or shortening of the electron beam.

The change of shape of the cross section of the electron beam can be based on essentially the same surface area in the plane of the slits or can be combined with a widening or shortening of the electron beam and thereby with an enlargement or a reduction of the surface area in the plane of the slits.

In an example, the modification device comprises an electric and/or magnetic subdevice. Electric subdevices could be biased electrodes in the cathode which modify the local electric field in the vicinity of the electron emitter such that the emitting area is modified. Magnetic subdevices could be magnetic quadrupole lenses or cylinder lenses or magnetic dipoles.

In an example, the modification device may be configured to modify the electron beam so that the generated photon flux is essentially stable when the electron beam hits one of the anode's slits. The modification device may also be configured to modify the electron beam so that the generated photon flux is fluctuating by less than 90%, preferably less than 70%, more preferably less than 30%, and even more preferably less than 10% when the electron beam hits one of the anode's slits compared to when the electron beam hits the anode outside of the anode's slits.

According to the present invention, also a system for X-ray imaging is presented. The system comprises an X-ray source and an X-ray detector. The X-ray source comprises the modification arrangement as described above with a cathode, an anode and a modification device. The X-ray detector converts attenuated X-rays to electrical signals.

According to the present invention, also a modification method for an X-ray generating device is presented. It comprises the following steps, not necessarily in this order:

a) providing an electron beam;

b) rotating an anode under impact of the electron beam, wherein the anode is segmented by slits being present radially inwards into the outer circumference of the anode traversing the focal track and substantially equidistantly arranged around the anode's circumference; and c) modifying the electron beam when hitting one of the anode's rotating slits.

In an example, the modification device is also configured to modify the electron beam when one of the slits is approaching and/or departing the electron beam.

The modification of the electron beam can be understood as a modification of a focal spot of the electron beam at a position, where the electron beam impinges on the anode. In an example, the modifying of the electron beam when hitting one of the slits is a deflection, change of shape and/or a widening or shortening of the electron beam.

According to the present invention, also a computer program element is presented, wherein the computer program element comprises program code means for causing a modification arrangement as defined in the independent device claim to carry out the steps of the modification method when the computer program is run on a computer controlling the modification arrangement.

It shall be understood that the modification arrangement, the modification method, the computer program element for controlling such device and the computer readable medium having stored such computer program element according to the independent claims have similar and/or identical preferred embodiments, in particular, as defined in the dependent claims. It shall be understood further that a preferred embodiment of the invention can also be any combination of the dependent claims with the respective independent claim.

These and other aspects of the present invention will become apparent from and be elucidated with reference to the embodiments described hereinafter.

BRIEF DESCRIPTION OF THE DRAWINGS

Exemplary embodiments of the invention will be described in the following with reference to the accompanying drawings.

DETAILED DESCRIPTION OF EMBODIMENTS

Figure 1:
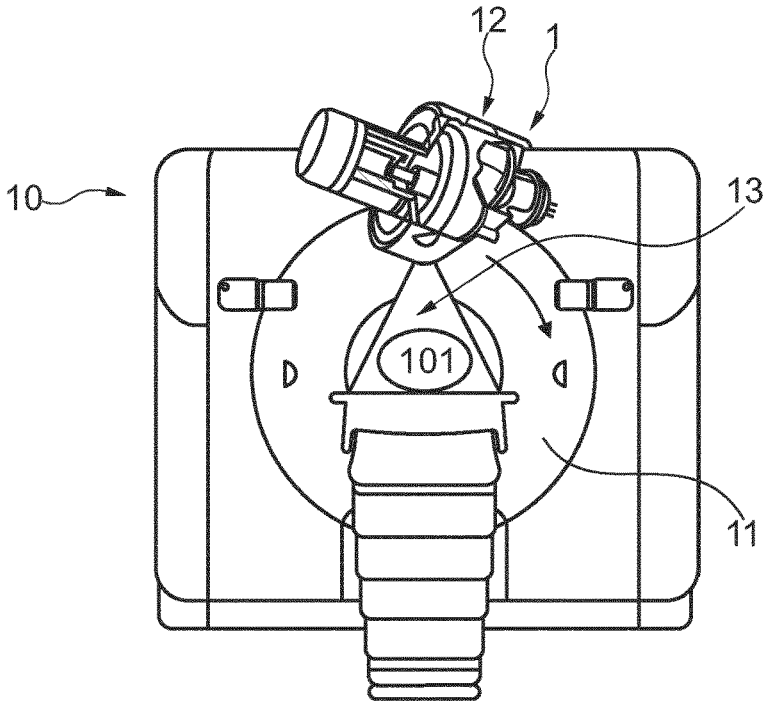
FIG. 1 shows a schematic drawing of an embodiment of a system for X-ray imaging and a modification arrangement according to the invention.

FIG. 1 shows schematically and exemplarily an embodiment of a system 10 for X-ray imaging according to the invention. The system 10 comprises a gantry 11 with an X-ray source 12 and an X-ray detector. The gantry 11 is rotatable about a patient 101 under examination. The X-ray source 12 generates an e.g. cone shaped beam of X-rays 13. Opposite to the X-ray source 12 on the gantry 11 is a detector system, which converts the attenuated X-rays 13 to electrical signals. A computer system (not shown) reconstructs an image of the patient's inner morphology.

The X-ray source 12 comprises an exemplary embodiment of a modification arrangement 1 according to the invention. The modification arrangement 1 comprises a cathode, an anode and a modification device. The cathode provides an electron beam. The anode rotates under impact of the electron beam. The modification device comprises an electric and/or magnetic subdevice.

Figure 2:
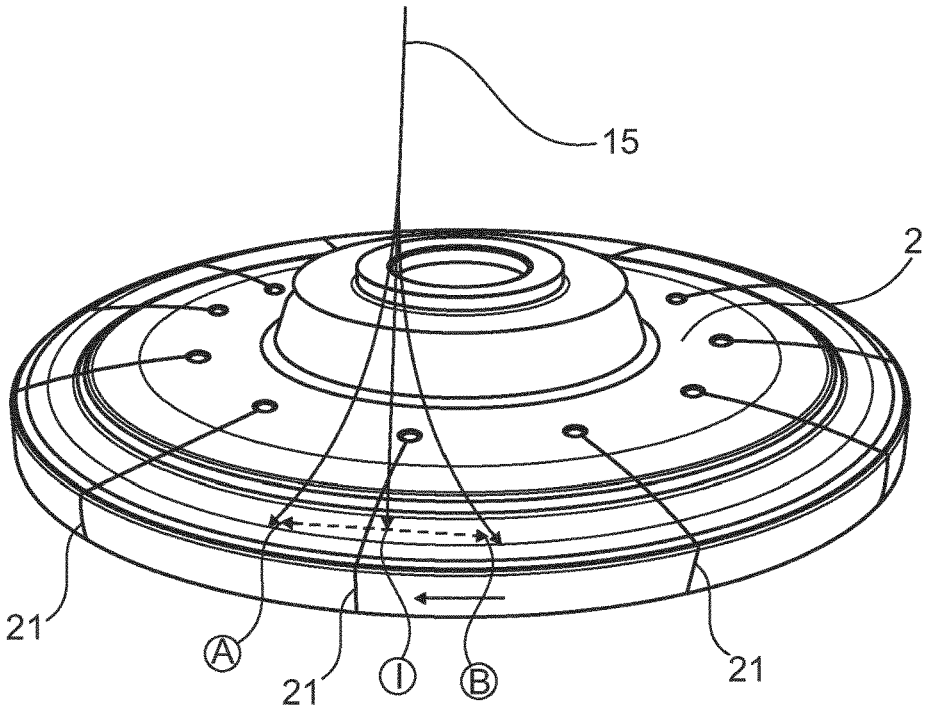
FIG. 2 shows schematically and exemplarily an anode as part of a modification arrangement according to the invention.

FIG. 2 shows schematically and exemplarily the anode 2. The anode 2 is segmented by slits 21 arranged around the anode's circumference. The modification device modifies the electron beam 15 when the electron beam 15 is hitting one of the anode's rotating slits 21. The modification device also modifies the electron beam 15 when one of the slits 21 is approaching and departing the electron beam 15. This means, as soon as one of the slots which rotates with the anode 2 approaches the position where the electron beam 15 hits the anode 2 and where the X-radiation is generated, the electron beam 15 is modified. The modification of the electron beam 15 can be understood as a modification of a focal spot of the electron beam 15 at a position, where the electron beam 15 impinges on the anode 2.

In a time sequence, first, when no slit is close to the position where the electron beam 15 hits the anode 2, the electron beam 15 is not modified. It this initial position I, the focal spot of the electron beam 15 is stable.

Then, when a slit 21 approaches the position where the electron beam 15 hits the anode 2, the electron beam 15 is modified, namely is here deflected in a tangential deflection relative to the rotational movement of the anode 2. In FIG. 2, the electron beam 15 is deflected forward in the direction of the anode's rotational movement to a position A (as shown by the arrow).

When the slit 21 has passed the position where the electron beam 15 originally hit the anode 2 at position I, the electron beam 15 is again modified, which means here rapidly deflected in the opposite direction. In FIG. 2, the electron beam 15 is deflected backward against the direction of the anode's rotational movement to a position B (as shown by the arrow). Thereby, the time during which the electron beam 15 hits one of the slits 21 is reduced.

When the slit 21 has departed also the region next to the position where the electron beam 15 hits the anode 2, the electron beam 15 is again modified, which means deflected in the opposite direction back to the initial position I.

Thereby, the electron beam 15 passes the slit 21 in a fast pace so the period of time is minimized during which the photon flux is reduced. Thereby, a stabilizing of the photon flux from the segmented rotating anode 2 is achieved. In other words, a dip of the photon flux during passage of a slit 21 in the anode 2 is reduced. No or nearly no signal bursts appear and the corresponding undesired noise is also completely or nearly avoided. As a result, the detection and/or reconstruction of an image are improved and thereby the quality of image data is increased.

This modifying of the electron beam 15 by deflection can be extended (or replaced) by a widening or shortening of the electron beam 15. It can further be extended (or replaced) by a change of shape of the electron beam 15, e.g. from a rectangular shape to a diagonal trapezoid shape.

Figure 3:
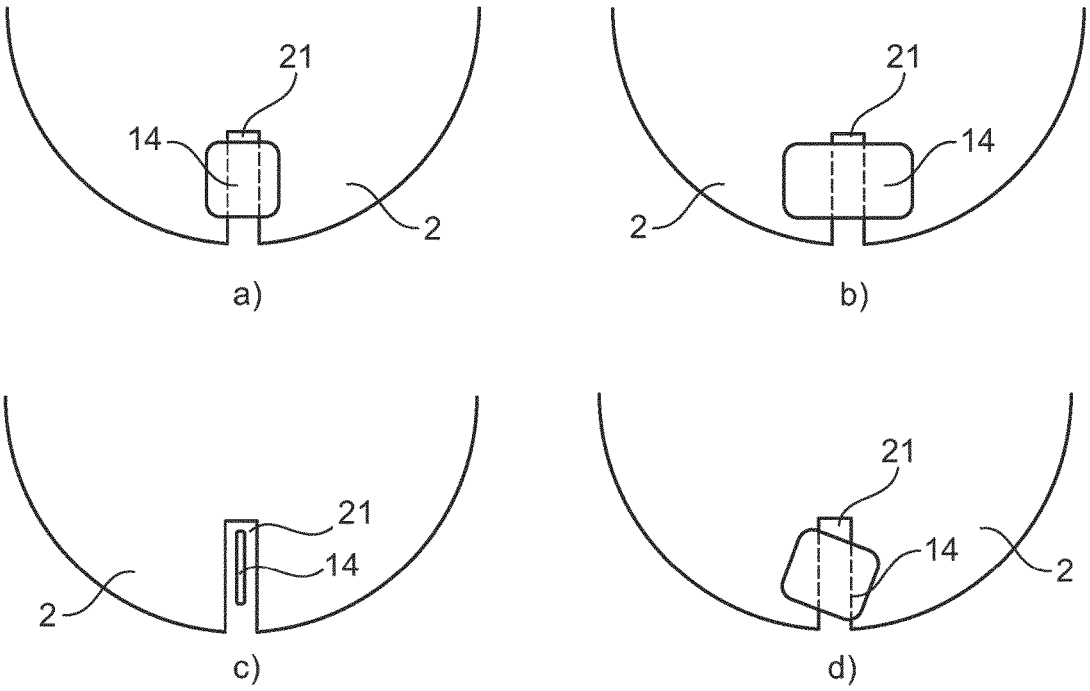
FIG. 3 shows schematically and exemplarily several views of an anode and a focal spot of an electron beam.

FIG. 3 shows schematically and exemplarily several views of a rotating anode 2 with a slit 21 and a focal spot 14 of an electron beam (not shown). The focal spot 14 is at the position, where the electron beam hits or impinges the anode 2. In FIG. 3*a*, the focal spot 14 is not modified.

In FIGS. 3*b* to 3*d*, the focal spot 14 is modified. In FIG. 3*b*, the focal spot 14 is widened in a tangential direction. The widening of the electron beam leads to an enlargement of the focal spot 14. In FIG. 3*c*, the focal spot 14 is shortened or shrunken in a tangential direction.

In FIG. 3*d*, the shape of the focal spot 14 is changed. In other words, the cross section of the electron beam in the plane of the slit 21 is changed. The initial square shape of the focal spot 14 as shown in FIG. 3*a* with the square standing on one of its sides is tilted or rotated so that the square now stands rhomb like on one of its corners. In comparison to the square shape standing on one of its sides, the rhomb like square standing on one of its corners is "jammed" in the slit 21, so that larger parts of the electron beam do not disappear in the slit 21. Further, this change of shape of the cross section of the electron beam in the plane of the slit 21 is combined with a widening as shown in FIG. 3*b*. The square focal spot 14 is slightly enlarged into a rectangular shape, which further enlarges the amount of the electron beam not disappearing in the slit 21.

Figure 4:
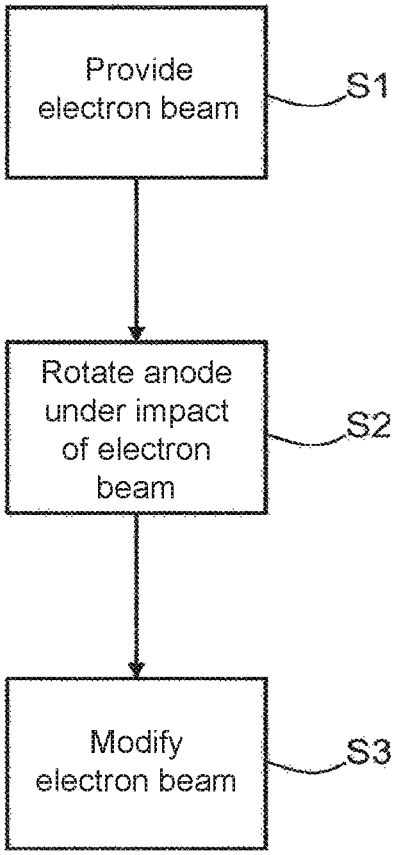
FIG. 4 shows basic steps of an example of a modification method.

FIG. 4 shows a schematic overview of steps of a modification method for an X-ray generating device. The method comprises the following steps, not necessarily in this order:

In a first step S1, providing an electron beam 15.

In a second step S2, rotating an anode 2 under impact of the electron beam 15, wherein the anode 2 is segmented by slits 21 being present radially inwards into the outer circumference of the anode traversing the focal track and substantially equidistantly arranged around the anode's circumference.

In a third step S3, modifying the electron beam 15 when hitting one of the anode's rotating slits 21.

The modification device can also be configured to modify the electron beam 15 when one of the slits 21 is approaching and/or departing the electron beam 15.

The modification of the electron beam can be understood as a modification of a focal spot of the electron beam at a position, where the electron beam impinges on the anode 2. The modification can be a deflection, a change of shape and/or a widening or shortening of the electron beam.

In another exemplary embodiment of the present invention, a computer program or a computer program element is provided that is characterized by being adapted to execute the method steps of the method according to one of the preceding embodiments, on an appropriate system.

The computer program element might therefore be stored on a computer unit, which might also be part of an embodiment of the present invention. This computing unit may be adapted to perform or induce a performing of the steps of the method described above. Moreover, it may be adapted to operate the components of the above described apparatus. The computing unit can be adapted to operate automatically and/or to execute the orders of a user. A computer program may be loaded into a working memory of a data processor. The data processor may thus be equipped to carry out the method of the invention.

This exemplary embodiment of the invention covers both, a computer program that right from the beginning uses the invention and a computer program that by means of an up-date turns an existing program into a program that uses the invention.

Further on, the computer program element might be able to provide all necessary steps to fulfil the procedure of an exemplary embodiment of the method as described above.

According to a further exemplary embodiment of the present invention, a computer readable medium, such as a CD-ROM, is presented wherein the computer readable medium has a computer program element stored on it, which computer program element is described by the preceding section.

A computer program may be stored and/or distributed on a suitable medium, such as an optical storage medium or a solid state medium supplied together with or as part of other hardware, but may also be distributed in other forms, such as via the internet or other wired or wireless telecommunication systems.

However, the computer program may also be presented over a network like the World Wide Web and can be downloaded into the working memory of a data processor from such a network. According to a further exemplary embodiment of the present invention, a medium for making a computer program element available for downloading is provided, which computer program element is arranged to perform a method according to one of the previously described embodiments of the invention.

It has to be noted that embodiments of the invention are described with reference to different subject matters. In particular, some embodiments are described with reference to method type claims whereas other embodiments are described with reference to the device type claims. However, a person skilled in the art will gather from the above and the following description that, unless otherwise notified, in addition to any combination of features belonging to one type of subject matter also any combination between features relating to different subject matters is considered to be disclosed with this application. However, all features can be combined providing synergetic effects that are more than the simple summation of the features.

While the invention has been illustrated and described in detail in the drawings and foregoing description, such illustration and description are to be considered illustrative or exemplary and not restrictive. The invention is not limited to the disclosed embodiments. Other variations to the disclosed embodiments can be understood and effected by those skilled in the art in practicing a claimed invention, from a study of the drawings, the disclosure, and the dependent claims.

In the claims, the word "comprising" does not exclude other elements or steps, and the indefinite article "a" or "an" does not exclude a plurality. A single processor or other unit may fulfil the functions of several items re-cited in the claims. The mere fact that certain measures are re-cited in mutually different dependent claims does not indicate that a combination of these measures cannot be used to advantage. Any reference signs in the claims should not be construed as limiting the scope.

The invention claimed is:

1. A modification arrangement for an X-ray device, comprising a cathode configured to provide an electron beam;

an anode configured to rotate under impact of the electron beam, the anode being segmented by slits arranged around a circumference of the anode;

a modification device configured to modify the electron beam when the electron beam is hitting one of the slits of the anode, wherein the modification device is configured to deflect the electron beam tangentially forward in or backward against a direction of a rotational movement of the anode, and then backward against or forward in the direction of the rotational movement of the anode to reduce time during which the electron beam hits one of the slits.

2. The arrangement according to claim 1, wherein the modification device is configured to modify the electron beam when one of the slits is approaching and/or departing the electron beam.

3. The arrangement according to claim 1, wherein the modification device is further configured to widen or shorten the electron beam in a radial and/or tangential direction.

4. The arrangement according to claim 1, wherein the modification device is further configured to change a shape of a cross section of the electron beam in the plane of the slits.

5. The arrangement according to claim 4, wherein the modification device comprises an electric and/or magnetic sub-device.

6. The arrangement according to claim 1, wherein the anode is configured to output a photon flux when the electron beam hits the anode, and wherein the modification device is configured to modify the electron beam so that the generated photon flux is essentially stable when the electron beam hits one of the slits.

7. The arrangement according to claim 6, wherein the anode is configured to output a photon flux when the electron beam hits the anode, and wherein the modification device is configured to modify the electron beam so that the generated photon flux is fluctuating by less than 90% when the electron beam hits one of the slits compared to when the electron beam hits the anode outside of the slits.

8. An X-ray imaging system, comprising:

an X-ray source that includes a modification arrangement comprising:

a cathode configured to provide an electron beam;

an anode configured to rotate under impact of the electron beam, the anode being segmented by slits arranged around a circumference of the anode;

a modification device configured to modify the electron beam when the electron beam is hitting one of the slits of the anode, wherein the modification device is configured to deflect the electron beam tangentially forward in or backward against a direction of a rotational movement of the anode, and then backward against or forward in the direction of the rotational movement of the anode to reduce time during which the electron beam hits one of the slits; and an X-ray detector.

9. A method for modifying an electron beam in an X-ray device, comprising:

providing an electron beam by the X-ray device;

rotating an anode under impact of the electron beam, wherein the anode is segmented by slits being present radially inwards into a circumference of the anode traversing a focal track and substantially equidistantly arranged around the circumference;

modifying the electron beam when hitting one of the rotating slits; and deflecting the electron beam tangentially forward in or backward against a direction of a rotational movement of the anode, and then backward against or forward in the direction of the rotational movement of the anode to reduce time during which the electron beam hits one of the slits.

10. The method according to claim 9, further comprising widening or shortening the electron beam.

11. A non-transitory computer-readable medium having one or more executable instructions stored thereon, which, when executed by a processor, cause the processor to perform a method for modifying an electron beam in an X-ray device, the method comprising:

providing an electron beam;

rotating an anode under impact of the electron beam, wherein the anode is segmented by slits being present radially inwards into a circumference of the anode traversing a focal track and substantially equidistantly arranged around the circumference;

modifying the electron beam when hitting one of the rotating slits; and deflecting the electron beam tangentially forward in or backward against a direction of a rotational movement of the anode, and then backward against or forward in the direction of the rotational movement of the anode to reduce time during which the electron beam hits one of the slits.

* * * * *